US009206643B2

(12) United States Patent
Kerr et al.

(10) Patent No.: US 9,206,643 B2
(45) Date of Patent: Dec. 8, 2015

(54) LEVELING LEG FOR A LADDER

(71) Applicant: MATERIAL CONTROL, INC., Crosswell, MI (US)

(72) Inventors: James F. Kerr, Croswell, MI (US); Nicholas J. Valore, Lexington, MI (US)

(73) Assignee: Material Control, Inc., Croswell, MI (US)

( * ) Notice: Subject to any disclaimer, the term of this patent is extended or adjusted under 35 U.S.C. 154(b) by 30 days.

(21) Appl. No.: 13/790,555

(22) Filed: Mar. 8, 2013

(65) Prior Publication Data

US 2014/0231171 A1 Aug. 21, 2014

Related U.S. Application Data

(60) Provisional application No. 61/765,980, filed on Feb. 18, 2013.

(51) Int. Cl.

| | |
|---|---|
| ***E06C 7/46*** | (2006.01) |
| *E06C 1/39* | (2006.01) |
| *E06C 1/397* | (2006.01) |
| *E06C 7/18* | (2006.01) |

(52) U.S. Cl.

CPC ... *E06C 7/46* (2013.01); *E06C 1/39* (2013.01); *E06C 1/397* (2013.01); *E06C 7/181* (2013.01)

(58) Field of Classification Search

CPC ..... E06C 1/38; E06C 1/397; E06C 5/36; E06C 7/00; E06C 7/188; E06C 7/42; E06C 7/423; E06C 7/44; E06C 7/46; E06C 1/39; E06C 7/181; Y10T 403/7084; Y10T 403/32491

USPC ..... 182/107–109, 200, 204, 201

See application file for complete search history.

(56) References Cited

U.S. PATENT DOCUMENTS

| | | | | |
|---|---|---|---|---|
| 2,213,471 | A * | 9/1940 | Minnick | 182/201 |
| 4,069,893 | A | 1/1978 | Blackstone | |
| 4,209,078 | A * | 6/1980 | Gerber | 182/203 |
| 4,359,138 | A | 11/1982 | Kummerlin et al. | |
| 4,457,397 | A | 7/1984 | Scala | |
| 4,565,262 | A | 1/1986 | Hawkins | |
| 5,480,002 | A | 1/1996 | Kerr | |
| 5,507,364 | A | 4/1996 | Spevak | |
| 5,526,898 | A | 6/1996 | Clark | |
| 5,653,307 | A | 8/1997 | Kerr | |
| 5,868,222 | A | 2/1999 | Charbonneau | |
| 5,913,382 | A | 6/1999 | Martin | |
| 6,293,367 | B1 | 9/2001 | Gulseth | |
| 6,305,496 | B1 | 10/2001 | Bieszczad | |
| 6,374,947 | B1 | 4/2002 | Nurkiewicz | |
| 6,382,353 | B2 | 5/2002 | Laug | |
| 6,435,306 | B2 | 8/2002 | Stoneburg | |

(Continued)

*Primary Examiner* — Daniel Cahn

(74) *Attorney, Agent, or Firm* — Dykema Gossett PLLC

(57) ABSTRACT

A rolling ladder includes opposing side members between which a plurality of treads are disposed at predetermined locations to define a ladder. The ladder further includes a support structure coupled to the ladder and including a front wheel support coupled to a plurality of rolling devices. A leg assembly has a user-adjustable length leg, allowing the user to extend or retract either leg to accommodate uneven or irregular floor surfaces. The leg length may also be adjusted to allow for wear in the material of the leg. A lock mechanism is responsive to user actuation and is configured to move the rolling devices from a rolling position to a retracted position, wherein the leg of the leg assembly contacts the floor to thereby inhibit movement of the ladder.

14 Claims, 11 Drawing Sheets

(56) References Cited

U.S. PATENT DOCUMENTS

| | | | |
|---|---|---|---|
| 6,450,292 | B1 | 9/2002 | Sheffield |
| 6,478,113 | B1 | 11/2002 | Ellison |
| 6,619,427 | B1 | 9/2003 | Kerr |
| 6,640,931 | B2 | 11/2003 | Palmer et al. |
| 6,729,440 | B1 | 5/2004 | Bailey |
| 6,779,632 | B1 | 8/2004 | Parks, III |
| 6,799,660 | B1 | 10/2004 | Crawford |
| 6,837,339 | B2 | 1/2005 | Lees |
| 6,997,282 | B1 | 2/2006 | Sharp et al. |
| 7,757,813 | B2 | 7/2010 | Kerr |
| 8,042,651 | B1 | 10/2011 | Michnik et al. |

* cited by examiner

LEVELING LEG FOR A LADDER

CROSS-REFERENCE TO RELATED APPLICATIONS

This application claims the benefit of U.S. provisional application No. 61/765,980, filed 18 Feb. 2013, which is hereby incorporated by reference as though fully set forth herein.

BACKGROUND a. Technical Field

The instant disclosure relates to an adjustable leveling leg for a ladder.

b. Background Art

This background description is set forth below for the purpose of providing context only. Therefore, any aspects of this background description, to the extent that it does not otherwise qualify as prior art, is neither expressly nor impliedly admitted as prior art against the instant disclosure.

It is known to provide a rolling ladder (e.g., typically metal) for a variety of purposes (e.g., access upper shelving of a storage facility). The rolling functionality is often desired as it allows the user to move the ladder from location to location within a facility. In a common configuration, the rolling functionality is implemented using casters or the like. Rolling ladders typically provide a mechanism to immobilize the ladder prior to the user ascending its steps, which is typically implemented by providing a relatively non-slip surface at the bottom of the ladder. In one implementation, a compression fitted crutch tip is installed directly on the ladder legs (i.e., in the case of tube frame ladder, the tube ends). The tip may typically comprise rubber ⅛ to ¼ inch thick. In another implementation, a rubber pad or "puck" is fastened to the end of the ladder legs via a welded sub-assembly, typically providing about 1 inch of thickness.

The foregoing discussion is intended only to illustrate the present field and should not be taken as a disavowal of claim scope.

BRIEF SUMMARY

One advantage of embodiments consistent with the present teachings includes the capability of extending out the leg to accommodate wear in the leg. Another advantage of embodiments includes the ability to extend (or retract) the leg in order to accommodate uneven or irregular flooring surfaces to level the ladder—and then to retract (or extend) the leg so as to adapt the ladder to new flooring conditions.

In an embodiment, a leg assembly is provided for use in a ladder. The leg assembly includes a leg having a first end and a second, opposing end. The first end is configured to engage a floor in the which the ladder is used. The leg comprises a material configured so as to inhibit, when the first end engages the floor, the ladder from rolling. The leg assembly further includes a pusher assembly coupled to the leg, and which includes a threaded bore (e.g., at one end). The leg assembly also includes a connecting rod extending along an axis with a threaded first end that is in mesh with the threaded bore of the pusher assembly. The connecting rod also includes a second end (e.g., the opposite end from the threaded first end). The leg assembly further includes an outer tube configured to house the leg. The outer tube restrains relative rotation between the tube and the leg. The tube, is further configured to house the pusher assembly and the connecting rod. Finally, the leg assembly includes a cap assembly coupled to the connecting rod at its second end. The cap assembly is configured to (i) fix the longitudinal position of the connecting rod relative to said outer tube, and (ii) allow rotation of the connecting rod about the longitudinal axis. The cap assembly is further configured, in response to user manipulation, to rotate the threaded first end of the connecting rod—in mesh with the threaded bore of the pusher assembly—to axially move the leg relative to the outer tube.

In another embodiment, the connecting rod can be rotated in either or both of clockwise and counter-clockwise directions, so as move the leg in or out of the outer tube.

In another embodiment, a ladder (e.g., rolling ladder) having an adjustable leg assembly is also presented.

The foregoing and other aspects, features, details, utilities, and advantages of the present disclosure will be apparent from reading the following description and claims, and from reviewing the accompanying drawings.

DETAILED DESCRIPTION

Figure 1A:
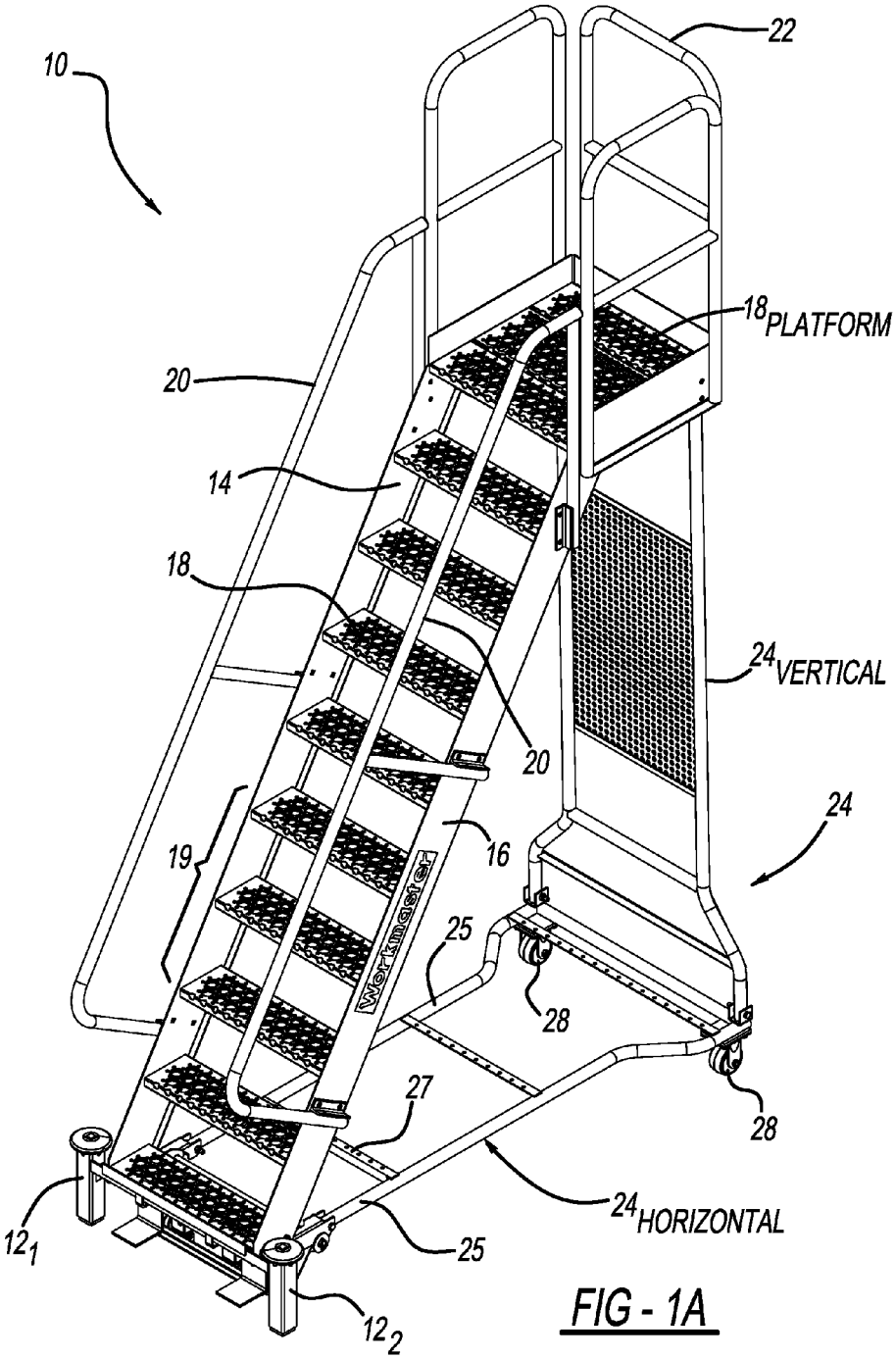
FIGS. 1A-1C are isometric, side, and front views of a ladder having, in an embodiment, a pair of adjustable leveling legs.

Referring now to Figures wherein like reference numerals identify identical or similar components in the various views, in embodiments of the instant disclosure, FIG. 1A is an isometric view of a ladder 10 including one or more adjustable leveling leg assemblies $\mathbf{12}_1$, $\mathbf{12}_2$. In an embodiment, the ladder 10 may be a so-called rolling metal ladder, and, subject to the improvements described herein, may comprise conventional components, such as a rolling metal ladder offered under the trade designation WORKMASTER® commercially available from Cotterman Company, Croswell, Mich., USA. Notwithstanding the illustrated embodiment of a rolling metal ladder, however, the improved leg assembly described herein may be used in connection with a wide range of ladders, platforms, and the like, including without limitation rolling metal ladders, rolling wood ladders, track-based ladders, fixed ladders, and the like, among other apparatus types.

With continued reference to FIG. 1A, leveling leg assemblies $\mathbf{12}_1$, $\mathbf{12}_2$ may include a telescoping leg formed of or incorporating a polymer (e.g., rubber) or other non-slip material suitable for immobilizing the ladder 10 when the legs are in contact with the floor or ground. In an embodiment, the extended length of the leg can be adjusted to accommodate for routine wear, and may be further length-adjusted to account for unevenness of the floor on which the ladder 10 may be used. In addition, as will be described below, a generally round (circular) bumper at the top of the leveling leg assemblies $12_1$, $12_2$ may serve both (1) as an impact bumper, and (2) as an adjustment mechanism that is user-adjustable so as to telescope the leg up or down as needed. In an embodiment, the user can raise or lower the (rubber) leg by rotating the bumper either clockwise or counter-clockwise with either a hand or foot (i.e., use of the foot eliminates the need of the user to bend over to adjust the bumper by hand). It should be understood that use of the term bumper does not require that the component actually serve as an impact-absorbing device, although in an embodiment, the component identified as the bumper may perform both of the above-identified functions.

In the illustrated embodiment of FIG. 1A, the ladder 10 includes a first side member 14, a second side member 16, and a plurality of treads 18 disposed at predetermined locations between the first and second side members 14, 16 to establish a stair frame 19. In FIG. 1A, ten treads 18 are shown. The uppermost tread, designated $18_{PLATFORM}$, is larger in area (i.e., deeper front-to-back) and may be used as a platform by the user. As further shown, the ladder 10 may further include one or more handrails, designated generally by reference numerals 20, 22. The handrail 20 is configured to facilitate the user ascending stair frame to the platform $18_{PLATFORM}$, while handrail 22 may be extended in height and configured to better safeguard the user.

The ladder 10 further includes a support structure 24 coupled to and configured to support the stair frame 19, including support of the platform tread $18_{PLATFORM}$. The support structure 24 may include a vertical support structure designated $24_{VERTICAL}$ and a horizontal support structure $24_{HORIZONTAL}$. The vertical support structure $24_{VERTICAL}$, which may comprise rigid tubular metal components, (i) is coupled to the stair frame 19 (including the platform tread $18_{PLATFORM}$) at a first, upper end and (ii) is coupled to the horizontal support structure $24_{HORIZONTAL}$ at a second, lower end thereof.

The horizontal support structure $24_{HORIZONTAL}$ may in turn also comprise rigid tubular metal components, and may be coupled between the lower end of the vertical support structure $24_{VERTICAL}$ and, in an embodiment, a front wheel support 31 (best shown in FIGS. 2A-2D). The horizontal support structure $24_{HORIZONTAL}$ may include a pair of generally longitudinally-extending members 25 and one or more transverse connecting members 27.

Figure 1B:
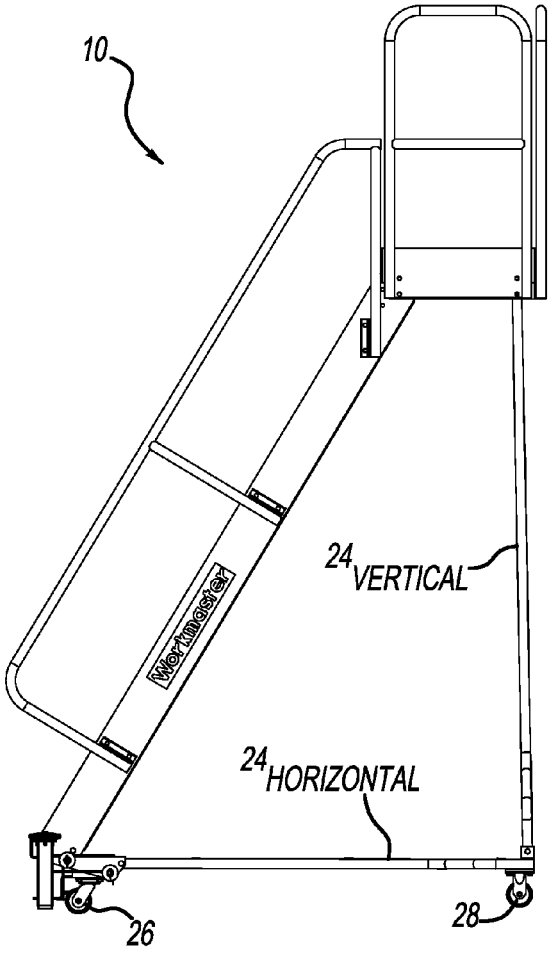

FIG. 1B is a side view of the ladder 10. In an embodiment, the ladder 10 includes a plurality of rolling devices, such as front caster wheels 26 and rear caster wheels 28, configured to enable the ladder to roll and thus be moved throughout a workspace. In alternate embodiments, other rolling devices may be used (e.g., skids).

Figure 1C:
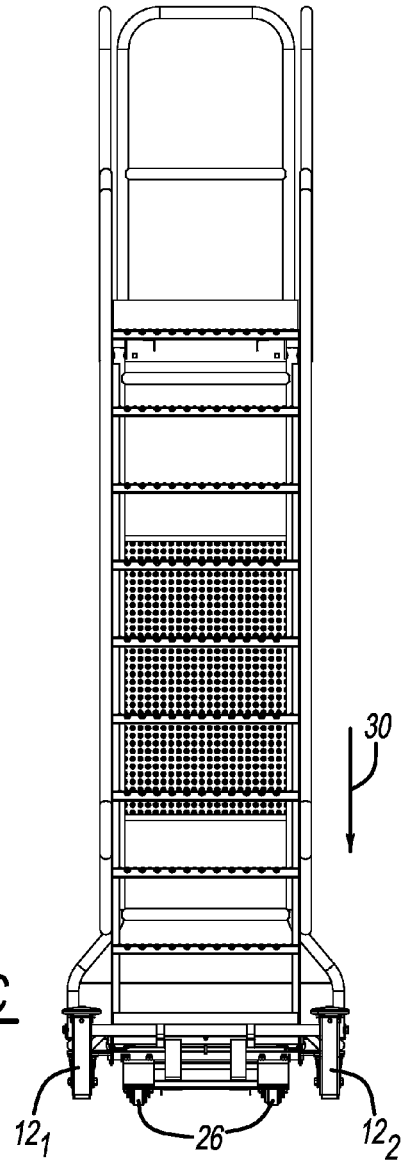

FIG. 1C is a front view of the ladder 10, looking into the stair frame 19. Generally, after the user has positioned the ladder 10 for use, and but before starting to ascend up the treads 18, in an embodiment, the weight of the user—applied via foot to a trip bar—can cause a lock mechanism (safe-lock) to rotatably raise the front caster wheels 26 relative to the ground or floor, whereby the leg assemblies $12_1$, $12_2$, can move downward in a direction 30 to engage the floor, generally immobilizing the ladder 10, i.e., minimizing or eliminating possible further movement of the ladder 10.

Figure 2A:
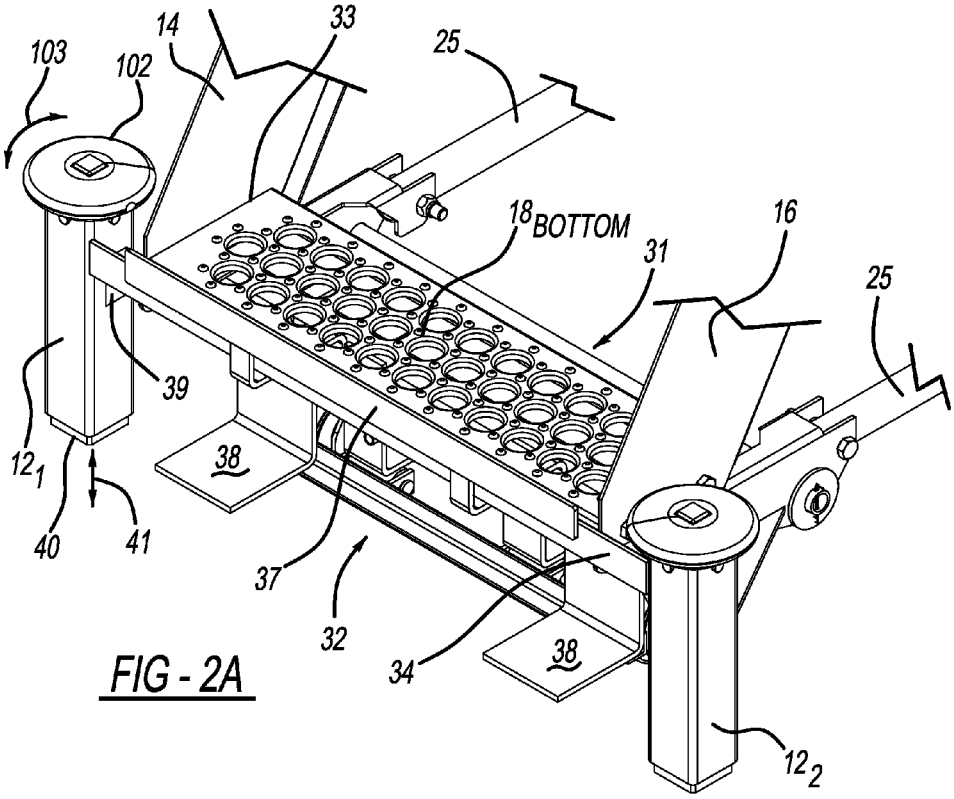
FIGS. 2A-2D are isometric, top, front, and side views of a portion of the ladder of FIG. 1A showing, in greater detail, the pair of adjustable leveling legs.

FIG. 2A is an isometric view of a lower, front portion of the ladder 10. The ladder 10 includes a front wheel support 31 disposed below the bottommost tread $18_{BOTTOM}$. The front caster wheels 26 are coupled to the front wheel support 31 by way of an intervening user-actuated locking mechanism 32 (a so-called safe-lock). Generally, the safe-lock 32 includes a trip bar 37 on which the user steps to rotatably raise the front caster wheels 26 relative to front wheel support 31, allowing the weight of the user and the ladder 10 to drop the leg assemblies $12_1$, $12_2$ to contact the floor. The safe-lock 32 may further include pedals 38, which the user can depress to reset the safe-lock 32, resetting the front caster wheels 26 from a retracted position to a deployed, rolling position.

The front wheel support 31 may include a pair of fork brackets or the like disposed on respective lateral sides thereof configured for respective connection to a pair of longitudinal support members 25, for example only, using conventional fasteners. In addition, the bottommost tread $18_{BOTTOM}$ may include a pair of receivers 33 (e.g., reinforced area with threaded holes) disposed on the lateral sides of the bottommost tread $18_{BOTTOM}$ configured to allow respective connection to side members 14, 16, as shown.

FIG. 2A also shows that the leg assemblies $12_1$, and $12_2$ are mechanically connected to the front wheel support 31, for example, through rigid support members (e.g., connecting plate 39) that extends from or is connected to front wheel support. In an embodiment, the leg assemblies $12_1$ and $12_2$ may be removably coupled to the front wheel support 31 at plate 39 and/or at the bottommost tread $18_{BOTTOM}$ by way of conventional, removable fasteners or the like. This feature allows for easy replacement should the leg assembly $12_1$ and $12_2$ become damaged, or the user otherwise wishes to replace the leg assembly to obtain a fresh (rubber) leg 40, since leg 40 may wear over time and require replacement.

As described above, the leg assemblies $12_1$, $12_2$ are user-adjustable in length. Each leg assembly therefore includes a user-actuatable adjustment means, such as a bumper 102 which can be rotated by the user in either a clockwise or a counter-clockwise direction 103 in order to raise or lower leg 40 in direction 41.

Figure 2B:
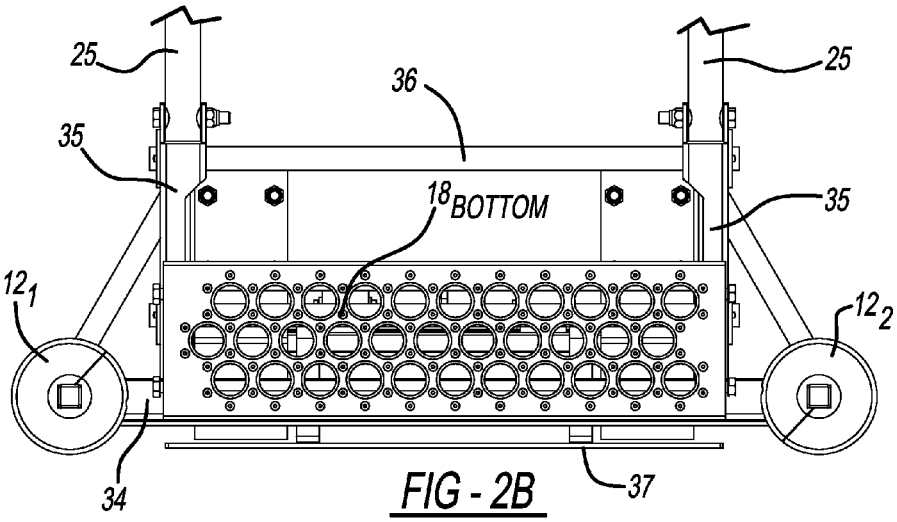

FIG. 2B is a top view of the tread $18_{BOTTOM}$ in relation to the front wheel support 31 and the leg assemblies $12_1$, $12_2$. In the illustrated embodiment, the front wheel support 31 may include a front member 34 (e.g., an angle iron or the like), a pair of side-members 35 at each lateral side, and a rear member 36 (e.g., a tube). The tread $18_{BOTTOM}$ is may be coupled to the front wheel support 31 by way of connection to the front member 34.

Figure 2C:
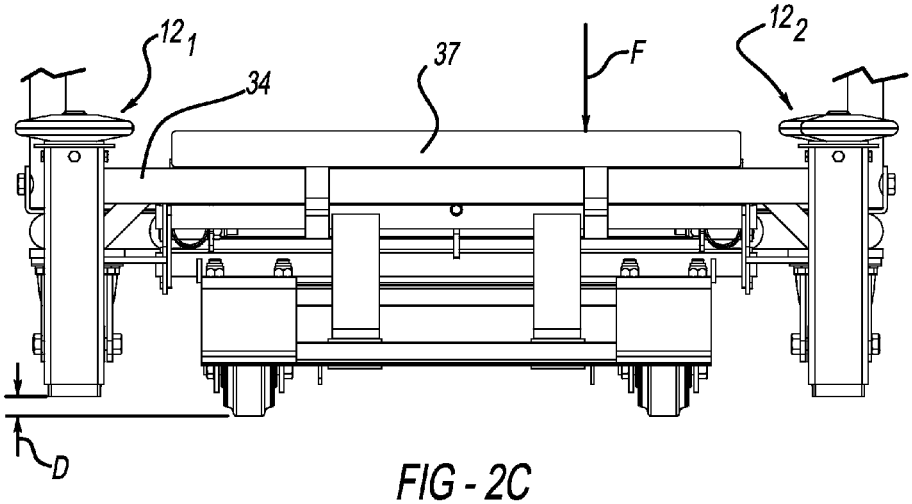
Figure 2D:
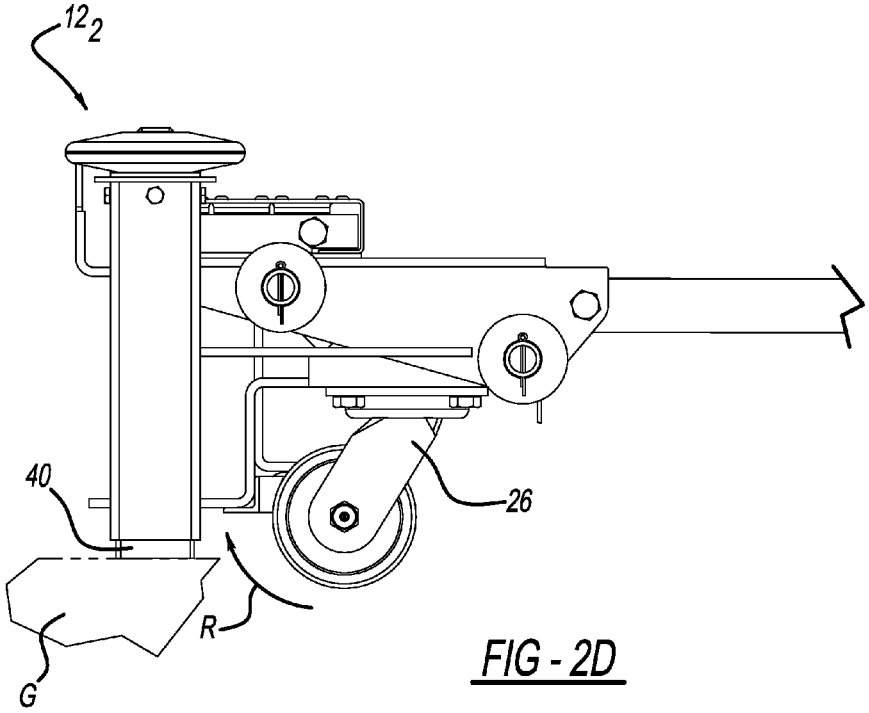

FIGS. 2C-2D are front and side view of the tread $18_{BOTTOM}$ in relation to the leg assemblies $12_1$, $12_2$. The safe-lock 32 is actuated when the user steps on the trip bar 37, placing his/her weight on the trip bar 37, such force being indicated by a downward arrow designated "F". When the trip bar 37 moves downward, the front caster wheels 26 are rotatably raised, as shown by the arrow designated "R" in FIG. 2D, thereby causing the weight of the ladder 10 and the user to force the leg assemblies $12_1$, $12_2$, and in particular the leg(s) 40 down to engage the floor or ground (designated "G" in FIG. 2D). It may be expected that the safe-lock mechanism 32 can raise the front caster wheels 26 enough to provide a certain degree of downward travel distance (designated "D" in FIG. 2C) of the leg assemblies before they engage the floor. To remove the leg assemblies from the floor to return the ladder 10 to a rolling condition by placing the front caster wheels 26 again in a rolling position, the user may step on either pedal 38, which resets the spring-return biased trip bar 37.

Figure 8A:
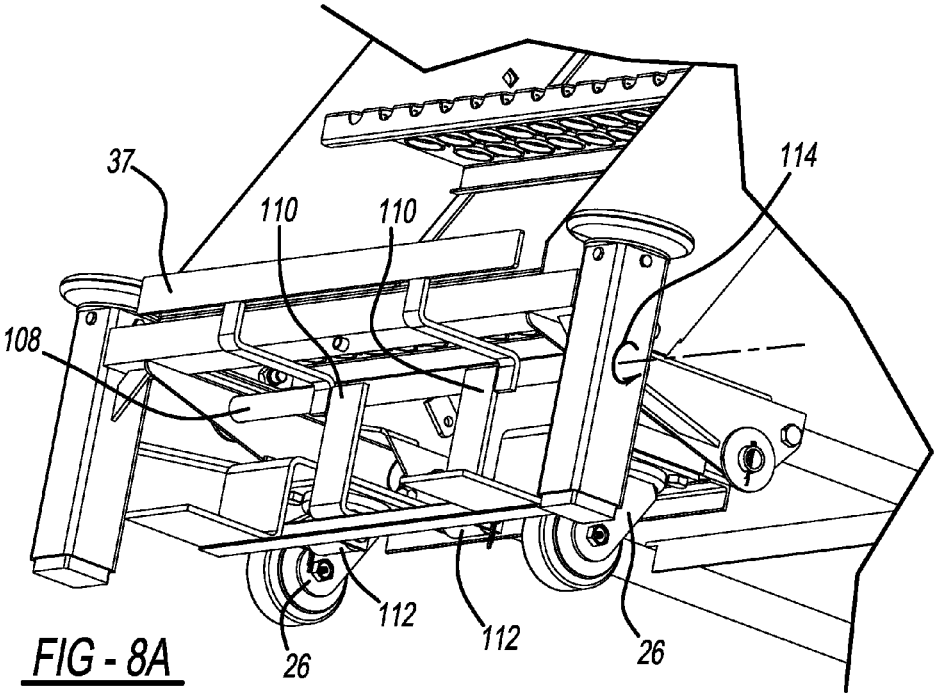
FIGS. 8A-8B are isometric, bottom views of a front wheel support and safe-lock mechanism, in accordance with an embodiment.
Figure 8B:
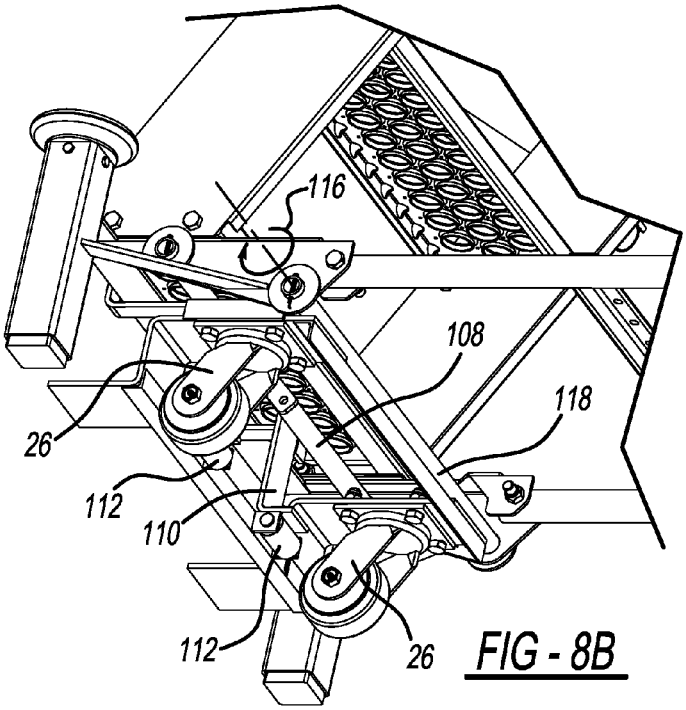

FIGS. 8A-8B are isometric views of a safe-lock 32, in an embodiment. As shown, the trip bar 37 (and the two generally S-shaped extensions thereof) are connected to a spring-biased tube 108. As further shown, generally L-shaped members 110 are also connected to tube 37 and rest on rollers 112 (also shown in FIG. 8B), which prevent the front caster wheels 26 from pivoting upwards (i.e., this structural arrangement maintains the caster wheels 26 in a deployed, rolling position). When the user steps on the trip bar 37, the downward travel of the trip bar 37 causes the tube 108 to rotate generally in the direction 114. This rotation in the direction 114 also rotates the L-shaped members 110 in the same direction. Referring to FIG. 8B, the lower "leg" of L-shaped members 110 move to the right and off of their rollers 112, which allows the structure on which the front caster wheels 26 are mounted to pivot or rotate in the direction 116 about the axis of tube 118. The front caster wheels 26 are then rotate away from the rolling position to a retracted position. As mentioned above, the safe-lock 32 can be reset by the user depressing one of the pedals 38, which moves the wheels 26 back into rolling position and resets the bottom leg of L-shaped members 110 on top of their respective rollers 112. In alternate embodiments, the safe-lock 32 may comprise conventional components and implementations, for example, as seen by reference to U.S. Pat. No. 6,305,496 (U.S. application Ser. No. 09/519,114, filed 6 Mar. 2000, the '114 application), entitled "SAFETY MOBILE LADDER STAND" and U.S. Pat. No. 5,480,002 (U.S. application Ser. No. 08/354,603, filed 13 Dec. 1994, the '603 application), entitled "DUAL TRACK MOUNTED LADDER SYSTEM". The '114 application and the '603 application are hereby incorporated by reference in their entirety, as though fully set forth herein, for all purposes.

Figure 3:
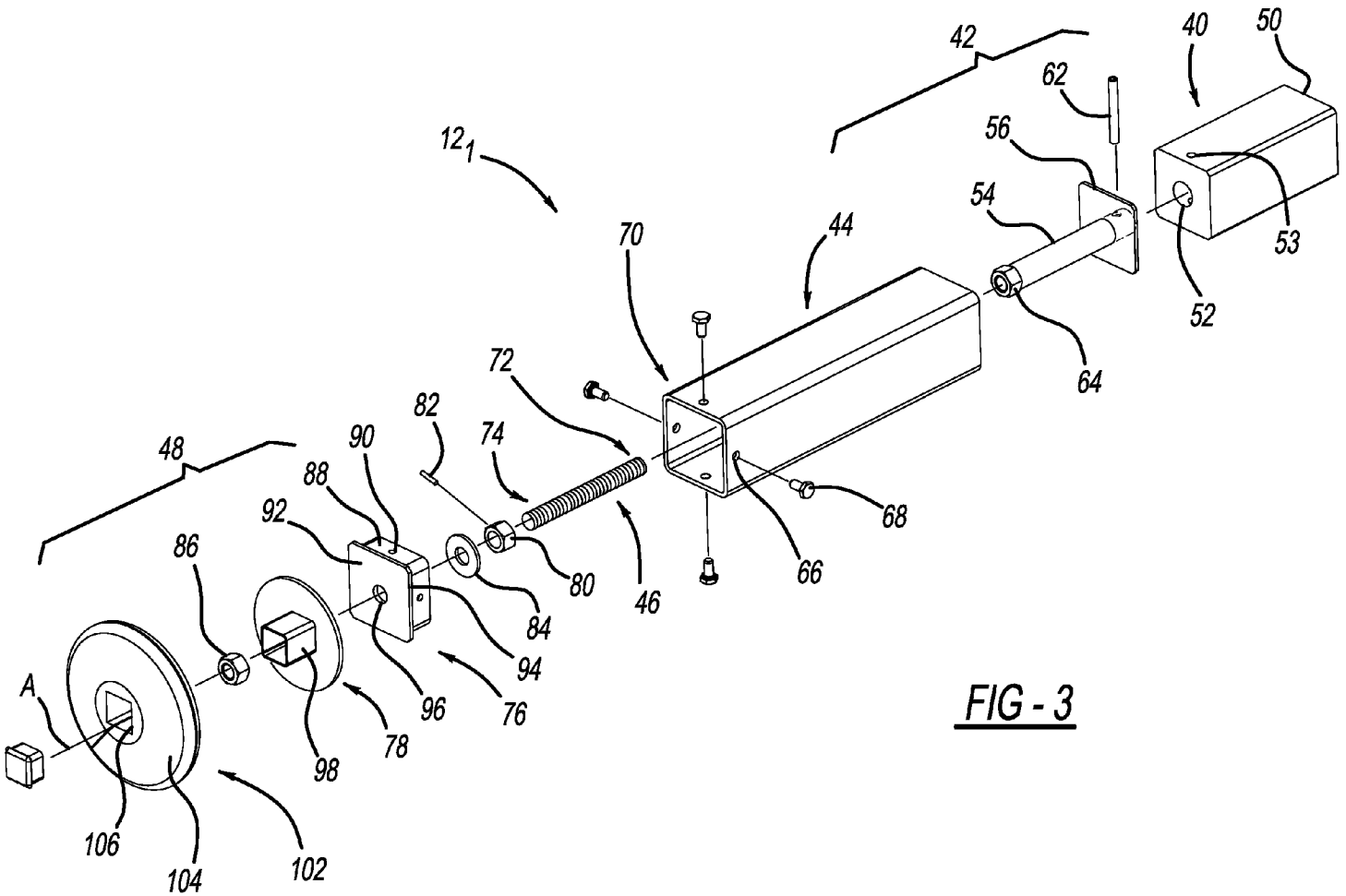
FIG. 3 is an exploded, isometric view of one of the leveling legs from FIG. 2A, as viewed from a first orientation.
Figure 4:
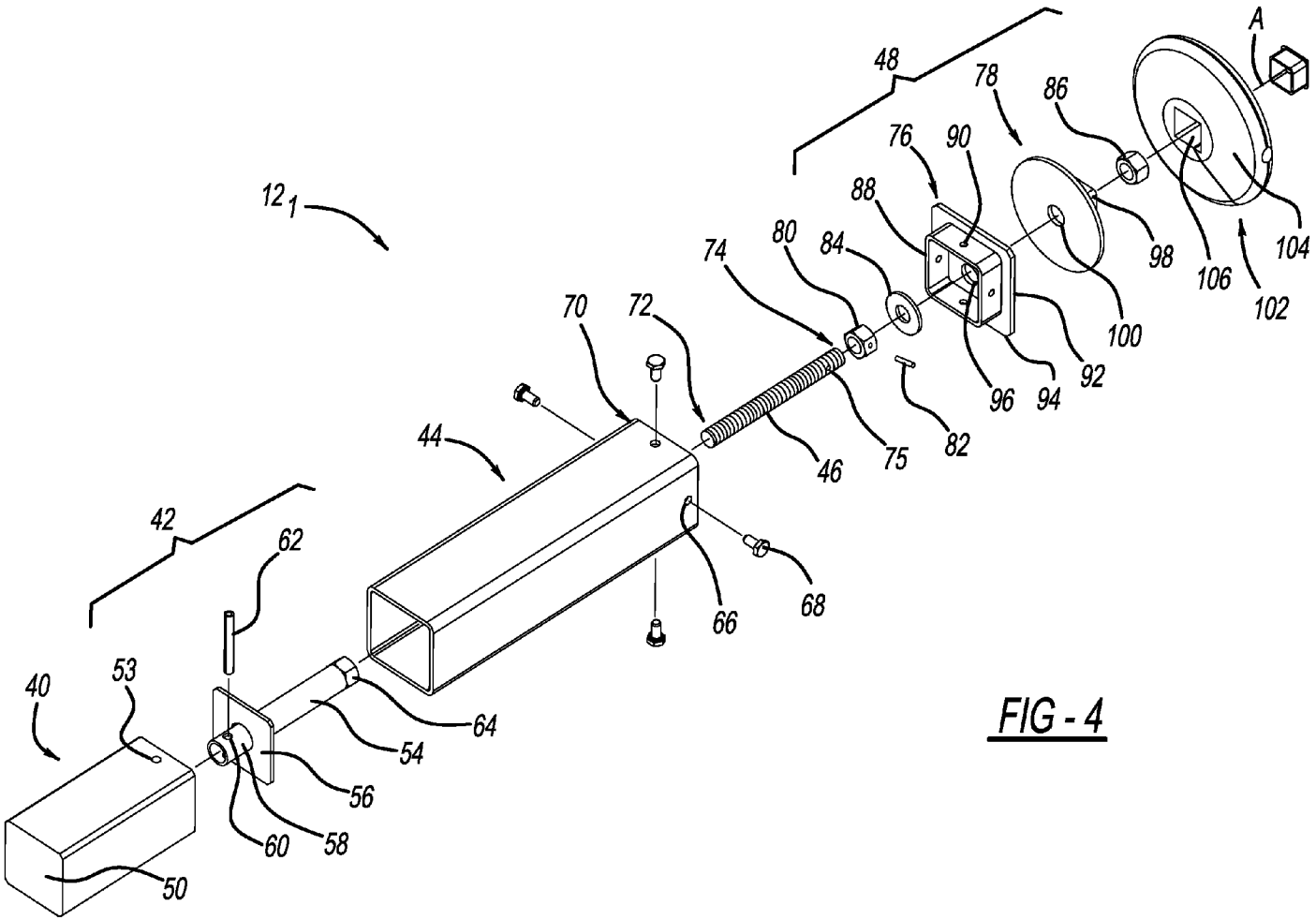
FIG. 4 is an exploded, isometric view of the leveling leg of FIG. 3 as viewed from a second, opposite orientation.

FIGS. 3-4 are isometric, exploded views of an embodiment of one of the leveling leg assemblies $\mathbf{12}_1$ or $\mathbf{12}_2$, taken from opposite perspectives, along a longitudinal axis designated "A" in the Figures. The leg assembly $\mathbf{12}_1$ includes a leg 40, a pusher assembly 42, an outer tube 44, a connecting rod 46, and a cap assembly 48.

The leg 40 includes a bottom-most end 50 configured to engage the floor when deployed. The leg 40 further includes a blind bore 52 at a topmost end thereof. As shown, the leg 40 is configured in size and shape to fit within the outer tube 44 (e.g., in a constructed embodiment, the leg 40 may have a generally square shape, for example, having outside side length of about 2 inches and may be about 5 inches long). In an embodiment, the leg 40 may comprise a relatively soft material, such as rubber or similar elastomeric material. The nature of the material is such that it provides a non-slip surface to engage the floor, while remaining relatively durable. The leg 40 may further include a transverse through-bore 53 configured to receive a roll pin 62 or the like, for the purpose of retention of the leg 40 to the pusher assembly.

The pusher assembly 42 includes a main tube portion 54 (i.e., generally thin-walled, rigid structure with a hollow interior), a flange portion 56, and a projection portion 58 (best shown in FIG. 4) configured in size and shape to be received within the blind bore 53, and a threaded portion 64 at a topmost end thereof, shown as a nut with inside threads.

Figure 5A:
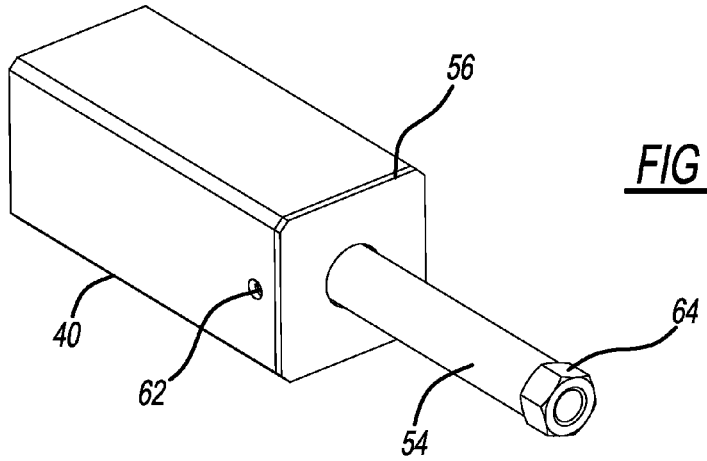
FIGS. 5A-5C are isometric, side (with hidden lines), and side views of the pusher assembly and foot of FIGS. 3-4.
Figure 5B:
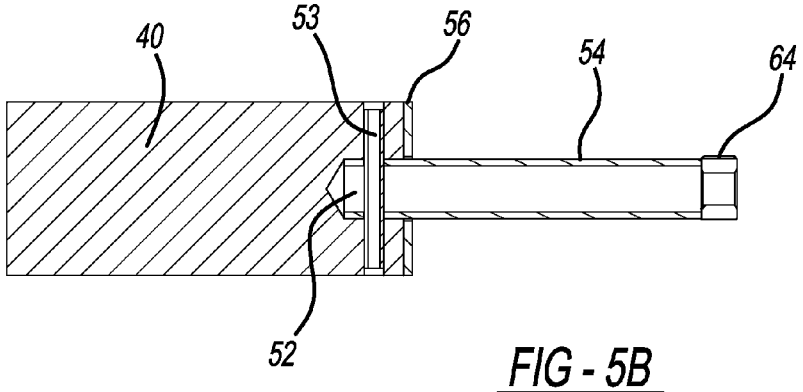
Figure 5C:
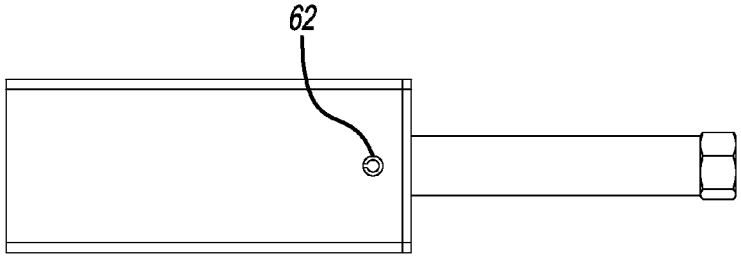
Figure 6A:
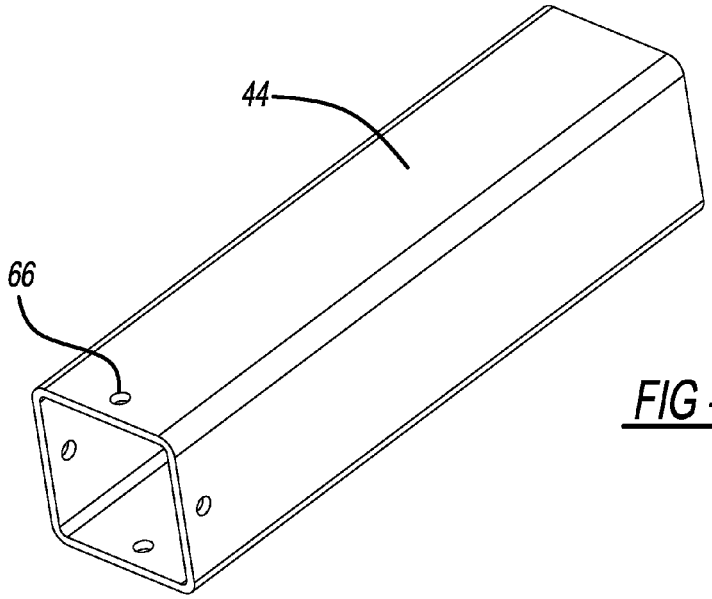
FIGS. 6A-6D are isometric, top, side, and front end views of the outer tube of FIGS. 3-4.
Figure 6B:
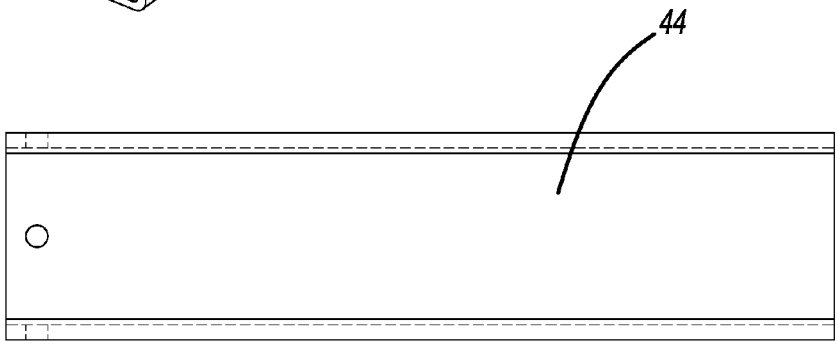
Figure 6C:
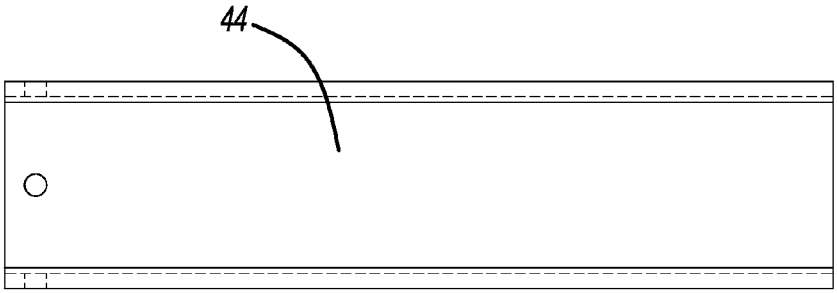
Figure 6D:
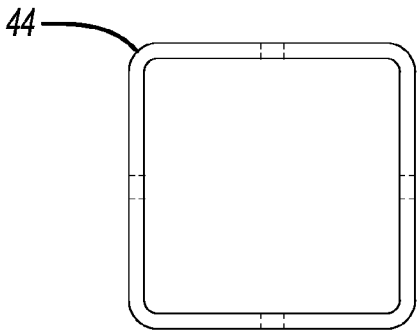

FIGS. 5A-5C show the leg 40 as assembled to the pusher assembly 42.

With continued reference to FIGS. 3-4, the outer tube 44 is configured to house the various other components of the adjustable leveling leg assembly $\mathbf{12}_1$, and may comprise a relatively strong, hollow tube. In an embodiment, the outer tube 44 may comprise metal, and, in a constructed embodiment, may comprise 10 gauge (GA) carbon steel tubing in a square shape (e.g., 2½ inches square in a constructed embodiment). It should be understood that the size and the square shape of the leg 40 in combination with the size and the square shape of tube 44 cooperate to limit movement of the leg 40 in the axial direction only (i.e., the leg 40 can move up and down in the tube 44, but cannot rotate). This aspect comes into play in the final assembly, where rotation of the connecting rod 46 in mesh with the pusher assembly results in up/down movement of the leg, as opposed to rotation of the leg 40 within the tube 40. Other configurations can also accomplish the foregoing (e.g., where at least one side of the leg faces a side of the tube such that the side will bear against each to limit relative rotation).

The outer tube 44 may further include a plurality of threaded apertures 66 (four are shown) configured to cooperate with a corresponding plurality of threaded fasteners 68 (four are shown). The fasteners 68 are used to retain the cap assembly 48 to the top end 70 of the outer tube 44.

FIGS. 6A-6D are isometric, top, side, and end views, respectively, of the outer tube 44.

With continued reference to FIGS. 3-4, connecting rod 46 is configured to convey rotational movement (from the bumper 102) to the pusher assembly 42, which causes the upward or downward movement of the leg 40 relative to the outer tube 44. In the illustrated embodiment, the connecting rod 46 includes outside threads. When assembled, the bottom-most end 72 of the threaded connecting rod 46 is received into and in mesh with the inside threads of nut 64 of the pusher assembly 42.

The cap assembly 48 is configured to establish and maintain a fixed longitudinal position of the connecting rod 46 relative to the outer tube 44, yet allow rotation of the connecting rod 46 within the outer tube 44, which serves to move the pusher assembly 42 up and down within the outer tube 44, much like a jack. The cap assembly 48 may include a cap 76, a bumper washer 78, a fixing nut 80, a roll pin 82, a washer 84, a top washer 86, and a bumper 102.

The cap 76 includes downwardly extending sidewalls 88, each sidewall of which has a threaded aperture 90 therethrough. The cap 76 further includes a top wall 92 with an overhanging shoulder 94 (best shown in FIG. 4). The cap 76 further includes a central through-hole 96 configured in size to allow the free, top end 74 of the connecting rod 46 to pass through. The cap 76 is configured in size and shape so that the sidewalls 88 fit into the top end 70 of the outer tube 44, but that the overhanging shoulder 94 contacts the top sidewalls of the outer tube 44 to thereby limit how far the cap 76 can go into the outer tube 44.

The fixing nut 80 (e.g., left hand threads in an embodiment) is threaded on the top end 74 of the connecting rod 46 to a predetermined axial position, and is then fixed by insertion of the roll pin 82. In the illustrative embodiment of FIG. 4, the connecting rod 46 has a transverse aperture 75, into which the roll pin 82 is inserted, which establishes a predetermined position of the nut 80 along the length of the connecting rod 46. In addition, the predetermined position of the nut 80 leaves a predefined amount of the end of the rod 46 free, which is then available for insertion through the washer 84, the cap 76, and the bumper washer 78.

The bumper washer 78 is generally circular in shape, and includes an upwardly extending nest 98 (best shown in FIG. 4) from a top surface thereof, which has a generally square shape. As will be described below, the shape of the nest 98 acts like a driver when coupled to the complementary shape formed in the bumper 102. The bumper washer 78 also includes a central through-hole 100 configured in size to allow the free end 74 of the connecting rod 46 to pass therethrough.

The bumper 102 includes a main body portion 104 that includes, in the illustrated embodiment, a generally square-shaped through-hole 106. The through-hole 106 is configured for a snug fit attachment to the bumper washer 78 and may be retained to the bumper washer through conventional attachment mechanisms (e.g., screw, press fit, etc).

Figure 7A:
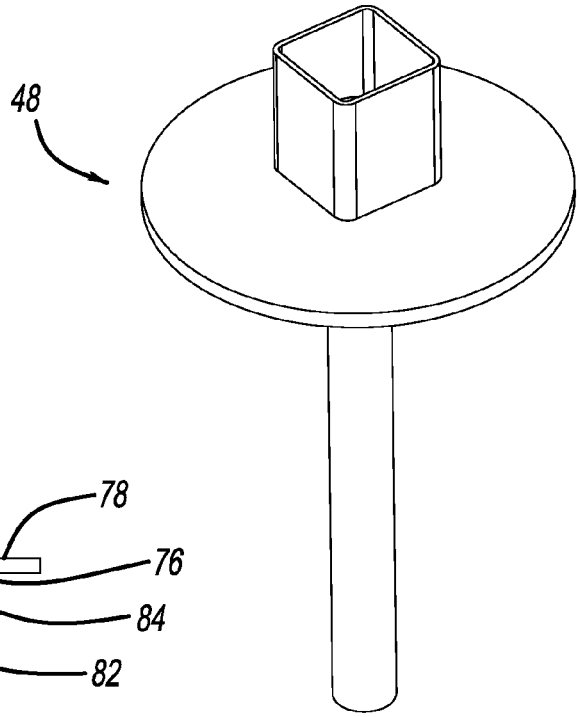
FIGS. 7A-7D are isometric, side, bottom, and further side views of the cap assembly of FIGS. 3-4.
Figure 7B:
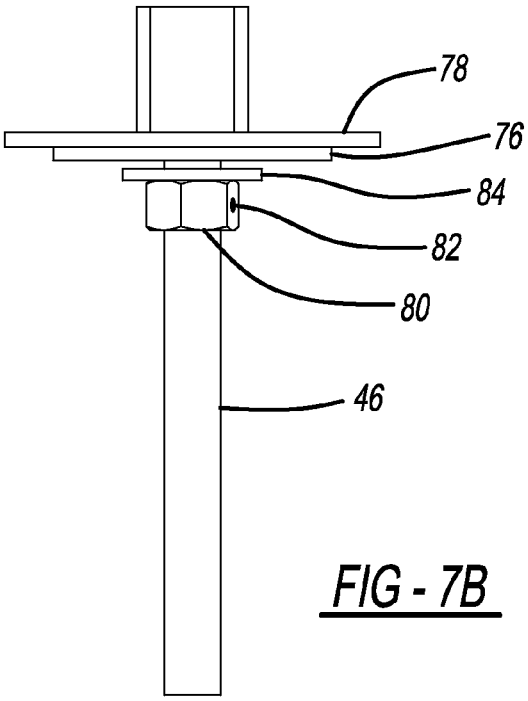
Figure 7C:
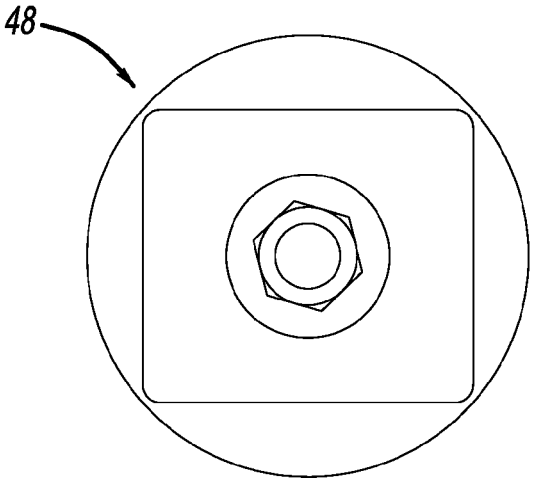
Figure 7D:
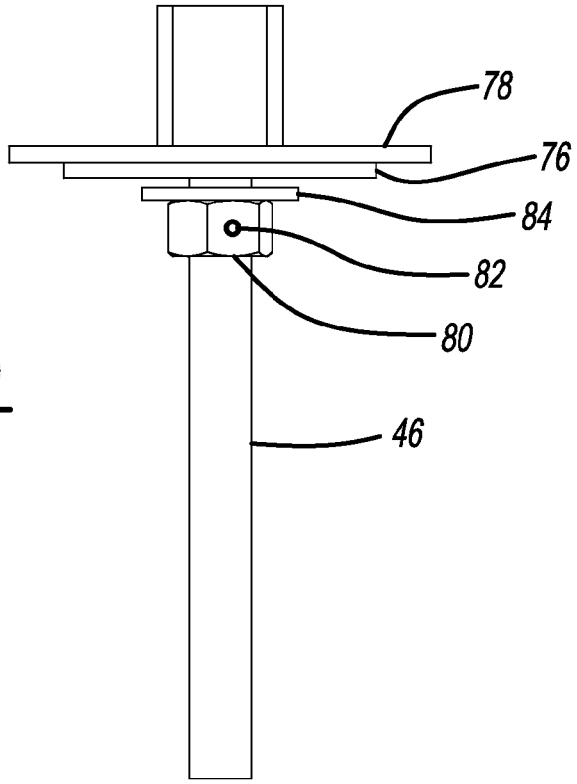

FIGS. 7A-7C show the cap assembly 48 in a partially assembled form (i.e., without bumper 102). Note that the bumper washer 78 rotates together with the connecting rod 46. FIGS. 7B and 7B show the rotation of nut 80 by virtue of the rotated position of the roll pin 82.

Assembly. The pusher assembly 42 is coupled to the leg 40 via the roll pin 62. The fixing nut 80 is affixed to the connecting rod 46 and is retained in place via the roll pin 82. The free end 74 of the connecting rod 46 is then inserted through the washer 84, then through the through-hole 96 of the cap 76 and through the through-hole 100 of the bumper washer 78, where the remaining free end 74 extends into the nest 98. The nut 86 is then screwed on the remaining free end 74 to mechanically rigidly couple the bumper washer 78 to the connecting rod 46 so that they rotate together. The bumper 102 may then be assembled onto the bumper washer 78, so that the central, square-shaped bore 106 fits onto the nest 98. The engaging sides of the bore 106/nest 98 allows rotation of the bumper 102 to be coupled to rotate the washer 78. The bottom end 72 of the connecting rod 46 is then threaded into the nut 64 of the pusher assembly 42. Once assembled, the components shown in FIGS. 3-4, other than the outer tube 44, comprise a single unit, which can then be inserted into the outer tube 44 and secured thereto by the plurality of fasteners 68.

Operation. In operation, when the user rotates the bumper 102, the bumper washer 78 also rotates, which in turn rotates the connecting rod 46. Since the bottom end 72 of the threaded connecting rod 46 is in mesh with nut 64, and the leg 40 cannot rotate within the interior of outer tube 44 due to the blocking surfaces of the square shape of the leg 40 and the square shape of the inside of the tube 44, the rotation of the connecting rod 46 causes the pusher assembly 42 to move either up or down within the outer tube 44, depending upon whether the rotation of the bumper 102 is clockwise (CW) or counter-clockwise. This axial movement of the pusher assembly 42 in turn operates to move the leg 40 up or down within the outer tube 44.

The user can rotate bumper 102 to index out leg 40 as desired to accommodate wear of the leg 40. In addition, one or both of the legs 40 of leg assemblies $\mathbf{12}_1$, and $\mathbf{12}_2$ can be adjusted by the user to accommodate any unevenness in the floor/ground on which the ladder 10 is being used. In addition, once the material of leg 40 has been completely spent and therefore in need of replacement, the four cap fasteners 68 can be removed, and the inner components can be removed from the outer tube 44. Then, the remaining stub of leg 40 can be removed and replaced with a new leg 40 having a full length. Alternatively, in some embodiments, the entire leg assembly 12 can be removed and replaced, for example, in the case of damage to the leg assembly 12.

It should be understood that the terms "top", "bottom", "up", "down", and the like are for convenience of description only and are not intended to be limiting in nature.

While one or more particular embodiments have been shown and described, it will be understood by those of skill in the art that various changes and modifications can be made without departing from the spirit and scope of the present teachings.

What is claimed is:

1. A leg assembly in combination with a ladder configured to support a user, the leg assembly in combination with the ladder comprising:

a leg having a first end and a second opposing end, said first end being configured to engage a floor, said leg formed of an elastomer material extending over an entire major longitudinal length between said first and second ends to inhibit, when said first end engages the floor, the ladder from rolling;

a pusher assembly coupled to said second end of said leg, said pusher assembly including a threaded bore;

a connecting rod extending along a major longitudinal axis of the leg assembly which is parallel to the major longitudinal length of said leg, the connecting rod having a threaded first end in mesh with said threaded bore of said pusher assembly, said connecting rod having a second end;

an outer tube housing said leg and restraining relative rotation therein, said tube further housing said pusher assembly and said connecting rod;

a cap assembly coupled to said connecting rod at said second end of said connecting rod in a manner configured to (i) fix a longitudinal position of said connecting rod relative to said outer tube, and (ii) allow rotation of said connecting rod about said axis, said cap assembly configured to be rotated by a user to cause rotation of said threaded first end of said connecting rod in mesh with said threaded bore of said pusher assembly to axially move both of said pusher assembly and said leg along said axis relative to said outer tube while said cap assembly remains axially fixed along said axis relative to said outer tube, and wherein, when in use, rotation of said connecting rod in a first direction extends said leg from said outer tube and rotation of said connecting rod in a second direction opposite the first direction retracts said leg into said outer tube, wherein said extension or retraction of said leg adjusts a length that said leg extends from said outer tube to allow for wear in the leg or to accommodate uneven or irregular floor surfaces.

2. The leg assembly of claim 1 wherein said material comprises rubber.

3. The leg assembly of claim 1 wherein said leg includes a first, flat side, said tube includes a corresponding flat side on an inside thereof, said first flat side and said corresponding flat side cooperating to prevent rotation of said leg within said tube.

4. The leg assembly of claim 1 wherein said pusher assembly includes a main tube with a projection portion at a first end and said threaded bore at a second end axially opposite said first end of said main tube, said pusher assembly further including a flange portion.

5. The leg assembly of claim 4 wherein said leg includes a blind bore at said second end of said leg, the blind bore configured in size to receive said projection portion of said pusher assembly such that said flange portion bears against said second end of said leg.

6. The leg assembly of claim 5 wherein said projection portion of said pusher assembly includes a first through-bore transverse of said axis, said leg including a second through-bore in registry with said first through-bore, further including a pin disposed in said first and second through-bores so as to retain said leg to said pusher assembly.

7. The leg assembly of claim 6 wherein said pin comprises a roll pin.

8. The leg assembly of claim 1 wherein said connecting rod includes at least one outside thread over substantially a length thereof.

9. The leg assembly of claim 1 wherein said outer tube comprises a plurality of sidewalls defining an interior, a top opening at a top end and a bottom opening at a bottom end.

10. The leg assembly of claim 9 wherein said sidewalls of said outer tube are flat, said leg including a corresponding number of flat sides.

11. The leg assembly of claim 9 wherein said cap assembly includes (i) a cap configured to close said top opening, (ii) a bumper washer adjacent to said cap, and (iii) a bumper adjacent to said bumper washer, wherein said bumper is configured for user manipulation for raising or lowering said leg.

12. The leg assembly of claim 11 wherein said cap is removably fastened to said top end of said outer tube.

13. The leg assembly of claim 11 wherein said bumper comprises a disc-shaped body having a first lateral extent, taken transverse to said axis, that is greater than a second lateral extent of said outer tube.

14. The leg assembly of claim 11 wherein said first direction is a clockwise direction, and said second direction is a counter-clockwise direction.

* * * * *